US007764266B2

(12) United States Patent
Ho et al.

(10) Patent No.: US 7,764,266 B2
(45) Date of Patent: Jul. 27, 2010

(54) METHOD AND SYSTEM FOR CONTROLLING AN ACTIVE MATRIX DISPLAY DEVICE

(75) Inventors: Yu-Hsi Ho, Kaohsiung (TW); Yu-Shian Yang, Shin Dian (TW); Chia-Horng Huang, Shin Ying (TW); Yao-Jen Hsieh, Jhubei (TW)

(73) Assignee: AU Optronics Corporation, Hsinchu (TW)

( * ) Notice: Subject to any disclaimer, the term of this patent is extended or adjusted under 35 U.S.C. 154(b) by 811 days.

(21) Appl. No.: 11/644,375

(22) Filed: Dec. 21, 2006

(65) Prior Publication Data

US 2007/0171317 A1 Jul. 26, 2007

Related U.S. Application Data

(60) Provisional application No. 60/762,100, filed on Jan. 24, 2006.

(51) Int. Cl.
*G09G 3/36* (2006.01)

(52) U.S. Cl. ..... 345/102; 345/99

(58) Field of Classification Search ..... 345/87–100, 345/204; 315/169.1–169.4
See application file for complete search history.

(56) References Cited

U.S. PATENT DOCUMENTS

| | | | | |
|---|---|---|---|---|
| 7,154,462 | B2 * | 12/2006 | Park et al. | 345/94 |
| 7,176,879 | B1 * | 2/2007 | Yoshihara et al. | 345/102 |
| 2001/0004252 | A1 * | 6/2001 | Park et al. | 345/92 |
| 2002/0067332 | A1 * | 6/2002 | Hirakata et al. | 345/102 |
| 2005/0083280 | A1 * | 4/2005 | Hiraki et al. | 345/87 |
| 2005/0248555 | A1 * | 11/2005 | Feng et al. | 345/204 |
| 2005/0259064 | A1 * | 11/2005 | Sugino et al. | 345/102 |
| 2006/0038771 | A1 * | 2/2006 | Hirakata et al. | 345/102 |
| 2006/0139302 | A1 * | 6/2006 | Chen et al. | 345/102 |
| 2006/0170639 | A1 * | 8/2006 | Kawaguchi et al. | 345/98 |

(Continued)

FOREIGN PATENT DOCUMENTS

| | | |
|---|---|---|
| CN | 1713031 | 12/2005 |

(Continued)

OTHER PUBLICATIONS

SID 05 Digest; K. Nishiyama et al.; "32" WXGA LCD TV Using OCB Mode, Low Temperature p-Si TFT and Blinking Backlight Technology"; pp. 132-135; 2005.

*Primary Examiner*—Nitin Patel
(74) *Attorney, Agent, or Firm*—Ware, Fressola, Van Der Sluys & Adolphson LLP

(57) ABSTRACT

In the liquid crystal display device having a back-light source for illumination, image data is provided to the panel in successive frames such that the optical response of the liquid crystal in each pixel within a frame period has an impulse-like shape. The back-light source is controlled to illuminate the liquid crystal display panel such that the illumination is provided to the pixels for only part of the frame period. The optical response curve has a rising portion followed by a falling portion, and the back-light source is controlled by a timing control module such that the back-light is turned off at least when the optical response curve is in the falling portion. It is also possible to remove the image data from the pixels, or to control the charging and discharging of the electrodes to produce the impulse-like shape.

19 Claims, 12 Drawing Sheets

U.S. PATENT DOCUMENTS

2006/0176261 A1* 8/2006 Nitta et al. ..... 345/94
2007/0222744 A1* 9/2007 Okita et al. ..... 345/102
2007/0273678 A1* 11/2007 Okita et al. ..... 345/204
2007/0296673 A1* 12/2007 Kang et al. ..... 345/92
2008/0094541 A1* 4/2008 Ma et al. ..... 349/69
2009/0073109 A1* 3/2009 Shin et al. ..... 345/102
2009/0184918 A1* 7/2009 Feng et al. ..... 345/102

FOREIGN PATENT DOCUMENTS

EP 1600928 11/2005
JP 2000321551 11/2008

* cited by examiner

METHOD AND SYSTEM FOR CONTROLLING AN ACTIVE MATRIX DISPLAY DEVICE

This patent application is based on and claims priority to U.S. patent application Ser. No. 60/762,100, filed Jan. 24, 2006, and assigned to the assignee of the present invention.

FIELD OF THE INVENTION

The present invention relates generally to an active-matrix display device and, more particularly, to a method and system for driving such display device.

BACKGROUND OF THE INVENTION

An active matrix display device, such as an active-matrix liquid crystal display (AMLCD) panel, has a two-dimensional pixel array comprising a plurality of pixel rows. Each of the pixel rows has a plurality of pixels arranged in the x direction, as shown in FIG. 1. These pixel rows are arranged as lines in the y direction so that they can be sequentially driven by a plurality of scanning signals provided by the scanning lines in one or more scanning circuits. In FIG. 1, the display panel 10 has a display area 20 comprising of pixels 22. Each pixel row is driven by a gate line Gn provided by a scanning circuit or gate line driver 40. The data signal to the pixel rows are provided on a plurality of data lines Dn provided by a source driver or data IC 30. In a transmissive type LCD panel and a transflective type LCD panel, a back-light source is used to provide illumination to the LCD panel from the back side of the panel.

In a liquid crystal display panel, due to the response time of the liquid crystal, sometimes an effect known as motion blur occurs in a sequence of animated pictures. Many attempts have been made to reduce or eliminate this artifact. One of the techniques for reducing the motion blur effect is to shorten the response time by overdriving the liquid crystal. Another technique is the black frame insertion technique wherein "blanking data" in one or more frames are supplied after an image frame has been displayed. Prior art solutions to the motion blur effect sometimes produce a certain undesirable artifact such as a ghost image or a double-edge image.

It is desirable and advantageous to provide a method for reducing the motion blur effect in an active-matrix display device.

SUMMARY OF THE INVENTION

In the liquid crystal display device, according to the present invention, image data is provided to the panel in successive frames such that the optical response of the liquid crystal in each pixel within a frame period has an impulse-like shape. In particular, a back-light source is adapted to provide light to illuminate the liquid crystal display panel in a controlled fashion such that the illumination is provided to the pixels for only part of the frame period. The optical response curve has a rising portion followed by a falling portion, and the back-light source is controlled by a timing control module such that the back-light is turned off at least when the optical response curve is in the falling portion.

Thus, the first aspect of the present invention is a method for operating a liquid-crystal display panel having a liquid crystal layer defining a plurality of pixels. The method comprising providing image data to at least some of the pixels for forming an image in successive frames, each frame having a frame period; and controlling the back-light source so that at least part of the back-light source is turned on in a first portion of the frame period and turned off in a second portion of the frame period.

According to one embodiment of the present invention, the image data provided to at least some of the pixels is removed from the pixels for producing the optical response. Advantageously, the charging and discharging of electrodes associated with at least some of the pixels causes the light transmitted in the pixels to produce an optical response having a rising portion followed by a falling portion in the frame period, and wherein at least part of the falling portion coincides with at least part of the second portion of the frame period.

In a liquid display panel where the pixels are arranged in a plurality of lines and the image data is provided to the lines in a scanning pattern in a scanning direction, the back-light source is designed to include a plurality of light source sections so that one section can be turned off at a time in a sequential manner within the frame period substantially in the same scanning direction and substantially in synchronism with the scanning pattern.

According to one embodiment of the present invention, the turning on of the back-light source can be carried out in steps and turning off part of the back-light source in a second portion of the frame period, and the steps include descending steps such that the falling portion of the optical response coincides with at least part of the descending steps.

The second aspect of the present invention is a liquid-crystal display device that comprises:

a liquid-crystal display panel having a liquid crystal layer defining a plurality of pixels for forming an image in successive frames, each frame having a frame period;

a back-light source disposed in relationship to the liquid-crystal display panel for providing light to illuminate the liquid crystal display panel from the back side; and a back-light control module for controlling the back-light source so that the light is provided to illuminate the pixels for only part of the frame period.

According to one embodiment of the present invention, the liquid crystal display device further comprises a data generator for providing the image data to the pixels in a controlled fashion, causing light transmitted in the pixels to produce an optical response having a rising portion followed by a falling portion in the frame period, and wherein at least part of the falling portion coincides with at least part of the second portion of the frame period.

According to one embodiment of the present invention, the liquid crystal display device further comprises a charging time controller for controlling charging and discharging of electrodes associated with the pixels, causing the light transmitted in the pixels to produce an optical response having a rising portion followed by a falling portion in the frame period, and wherein at least part of the falling portion coincides with at least part of the second portion of the frame period.

In a liquid crystal display device where the pixels are arranged in a plurality of lines and the image data is provided to the lines in a scanning pattern in a scanning direction and the back-light source comprises a plurality of light source sections, the back-light control module is configured to turn off one section at a time in a sequential manner within the frame period and also in the same scanning direction, and substantially in synchronism with the scanning pattern.

The third aspect of the present invention is a timing control device for use in a liquid-crystal display device having a back-light source for providing light to illuminate a liquid crystal display panel from the back side. The timing control device comprises an optical response control module for causing the light transmitted in the pixels to produce an optical response having a rising portion followed by a falling portion in the frame period, and wherein at least part of the falling portion coincides with at least part of the second portion of the frame period; and a back-light control module for controlling the back-light source so that the illumination is provided to the pixels for only part of the frame period. The back-light control module is configured to turn on at least part of the back-light source in a first portion of the frame period and turn off in a second portion of the frame period.

DETAILED DESCRIPTION OF THE INVENTION

Figure 2:
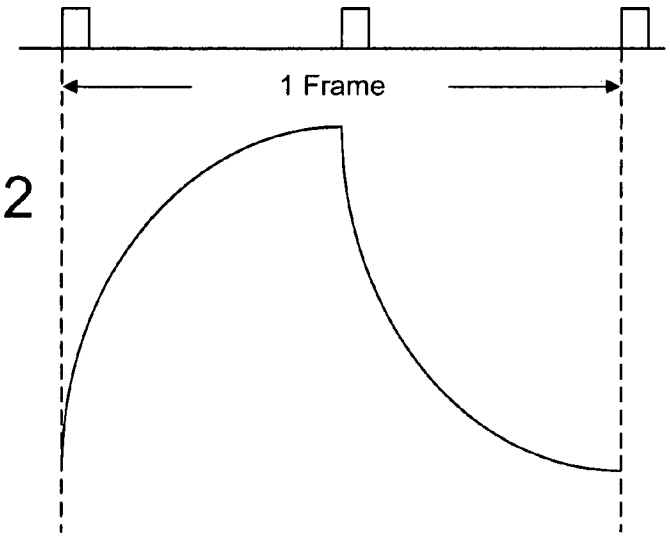
FIG. 2 shows an optical response curve of a pixel having an impulse-like shape.

In a liquid crystal display panel, image data can be provided to the panel in successive frames such that the optical response of the liquid crystal in each pixel within a frame time can have an impulse-like shape, as shown in FIG. 2. The optical response curve has a rising portion followed by a falling portion. The impulse-like optical response can be achieved by a number of methods. For example, the impulse-like optical response can be achieved by a black frame insertion technique where image data are controlled in order to reduce the motion blur. The impulse-like optical response can also be achieved by controlling the electrical charges in a pixel, such as charge sharing, for example.

Figure 3:
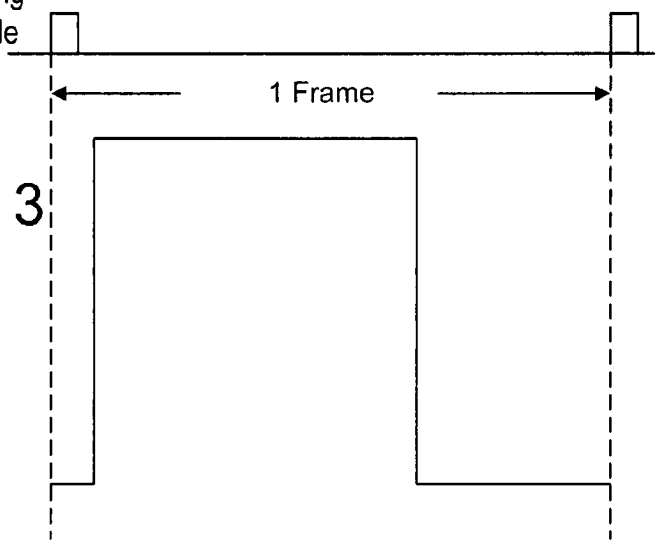
FIG. 3 shows an output response of a back-light source illuminating a pixel.

According to one embodiment of the present invention, the impulse-like optical response in a pixel is achieved by controlling a back-light source alone. In other embodiments, the impulse-like optical response is used in combination with one or more other methods such as the black frame insertion technique and the charge sharing technique. In order to achieve the impulse-like optical response using the back-light source, a back-light modulation module is used to turn on and off a back-light source in a controlled fashion. The control of the back-light source may yield a back-light output response as shown in FIG. 3. As shown in FIG. 3, the output response of the back-light source, within a frame time, has an ON-portion followed by an OFF-portion. It may have a shorter OFF-portion preceding the ON-portion.

When the output response of a back-light source is used in combination with an impulse-like optical response of a pixel, at least part of the off-portion of the output response of the back-light source coincides with the falling portion of the optical response curve. The timing relationship between the output response of the back-light source and the optical response of the pixel is shown in FIGS. 4*a* to 4*f*, for example. As shown in FIGS. 4*a* to 4*c* and 4*f*, the ON-portion of the back-light output response does not begin immediately at the start of a frame period. The reason for doing so is that the light intensity in a pixel corresponding to the starting rising portion of the optical response is low. It is not very beneficial to provide back-light illumination to the pixel at that early period. By delaying the turning on of the back-light source, energy can be saved. The duration of the ON-portion of the back-light output response can be lengthened or shortened, depending upon the requirement of motion blur reduction. For example, if the response time of the liquid crystal display is long, it would be beneficial to turn off the back-light source sooner so that the combined response time is effectively increased. As such, the effective falling of the optical response can be achieved faster and the motion blur reduction can be improved. A shortened ON-portion of the output response is shown in FIG. 4*b*.

Figure 4A:
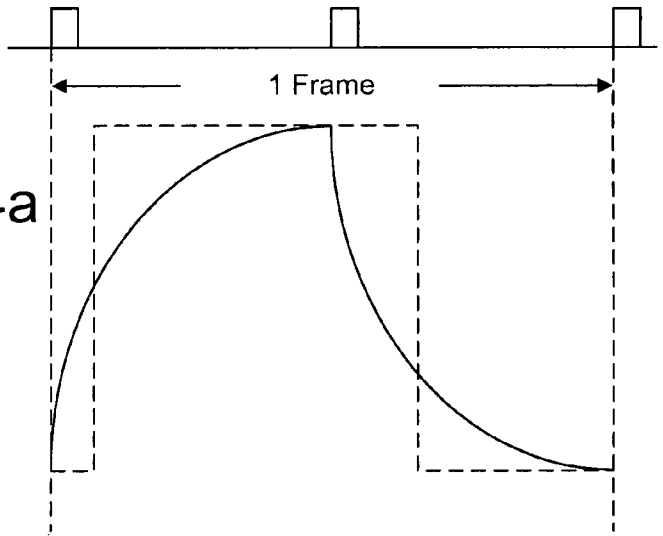
FIG. 4*a* shows the timing relationship between the optical response of a pixel and an output response of a back-light source illuminating the pixel.
Figure 4B:
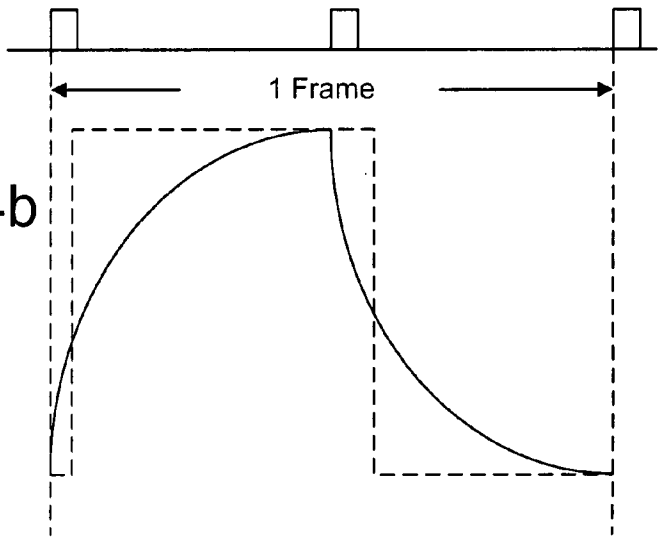
FIG. 4*b* shows the timing relationship between the optical response of a pixel and another output response of a back-light source illuminating the pixel.

In FIGS. 4*a* and 4*b*, the output response is depicted as a rectangular pulse. This suggests that the rise and fall of the output in response to the on-off control of the back-light source is almost instantaneous. In many light sources, however, the rise and fall of the output in response to the on-off control of the back-light source may take effects gradually. In such cases, the on-portion and the off-portion of the output response, as shown in FIGS. 4*c* and 4*d*, do not look like a rectangular pulse.

Figure 4E:
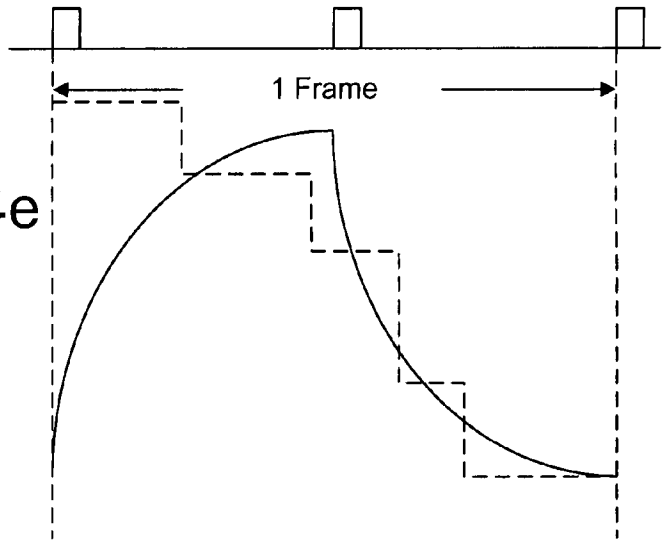
FIG. 4*e* shows the timing relationship between an optical response of a pixel and a step-like output response of a back-light source.
Figure 4F:
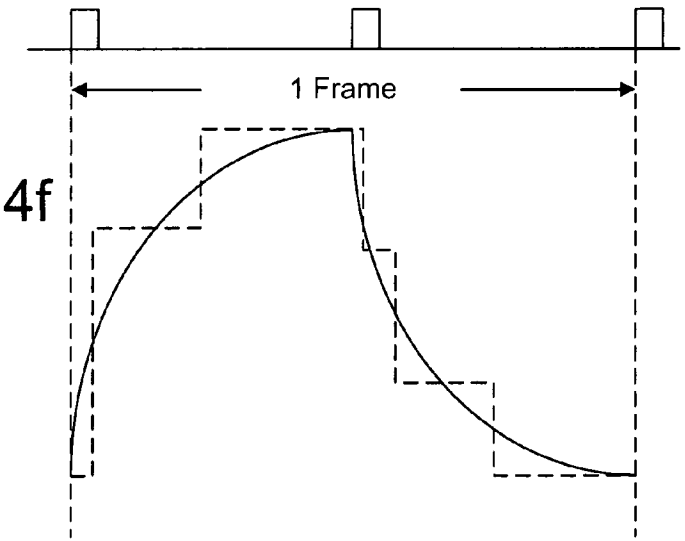
FIG. 4*f* shows the timing relationship between an optical response of a pixel and another step-like output response of a back-light source.
Figure 4C:
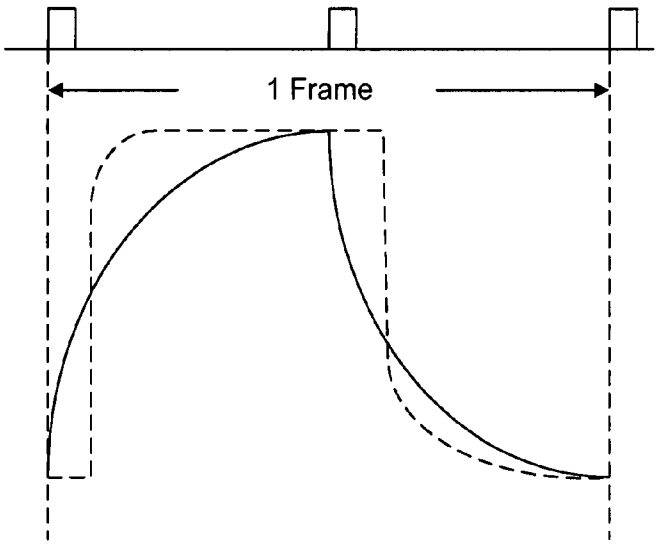
FIG. 4*c* shows the timing relationship between the optical response of a pixel and a different output response of a back-light source illuminating the pixel.

In FIGS. 4*a*-4*c*, the OFF-portion of the back-light output response covers only a section of the falling portion of the optical response curve. It would be more beneficial to have the OFF-portion of the back-light output response cover the entire falling portion of the optical response, as shown in FIG. 4*d*. The reason is that, when the optical response curve is in the falling portion, it is intended for the viewers to see a dark pixel. There is no need to keep the corresponding back-light source on at that time. Furthermore, the power consumption by the back-light source can be reduced when having a longest possible OFF-portion. The combination of the back-light output response and the impulse-like optical response is most beneficial when both the fall of the back-light output response and the fall of the impulse-like optical response are slow. In general, when the time for the liquid crystal to change from one state to another is relatively long as compared to a frame period, the dimming of the pixel brightness is not fast enough to produce a sufficiently dark pixel after the image data has been removed from the pixel. As a result, the motion blur due to the vision persistence or image retaining effect in our perceptual process, especially when the original luminance of the pixel is high, cannot be reduced effectively. Using an impulse-like back-light output response in combination with the impulse-like optical response, the fall of the optical response can be achieved in a much shorter time, as shown in the modified optical response in FIG. 4*d*. This means that the "dark" pixel period within a frame can be increased. Moreover, when the turning on of the back-light is delayed at the beginning of a frame period, the "dark" pixel period between two successive frames can be drastically extended. As shown in FIG. 4*d*, the dark pixel period is depicted as the period in which the luminance in a pixel falls below 10% of the peak luminance.

Figure 4D:
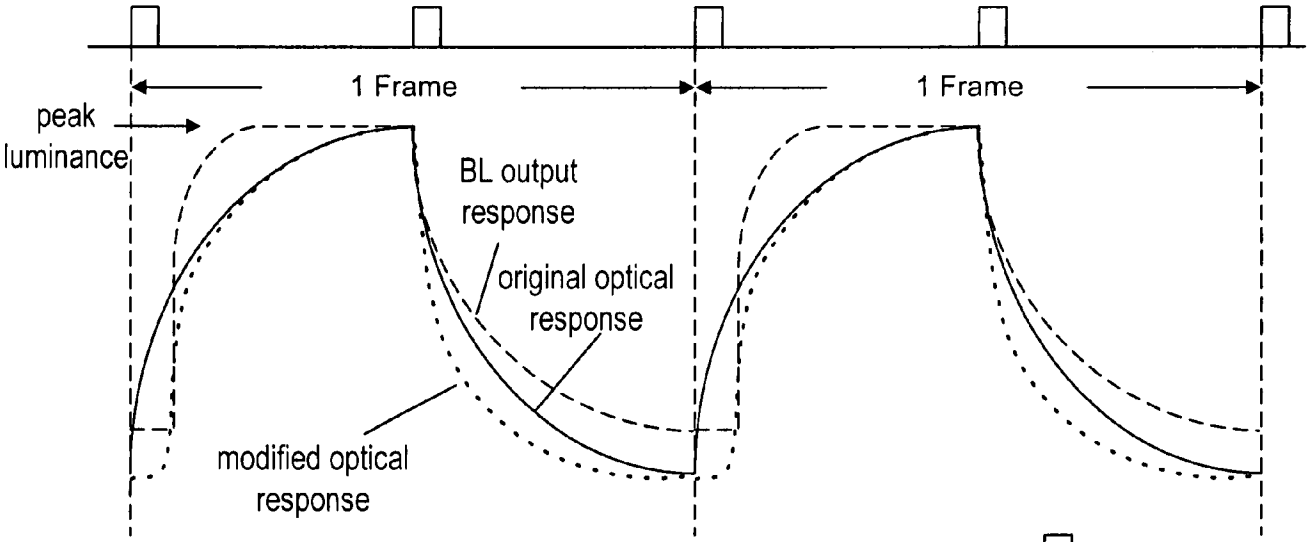
FIG. 4*d* shows the timing relationship between the optical response of a pixel and yet another back-light output response and the optical response of a pixel as modified by the back-light output response.

It would not be necessary to turn on or turn off the back-light source is a single step in order to produce an impulse-like back-light output response, as shown in FIGS. 3 to 4*d*. It is possible to turn the back-light source on and off in steps so that the back-light output response has two or more steps in the OFF-portion as shown in FIG. 4*e*. It is also possible to turn the back-light source on and off such that the output response of the back-light source has two or more steps both in the ON-portion and in the OFF-portion, as shown in FIG. 4*f*.

Figure 5:
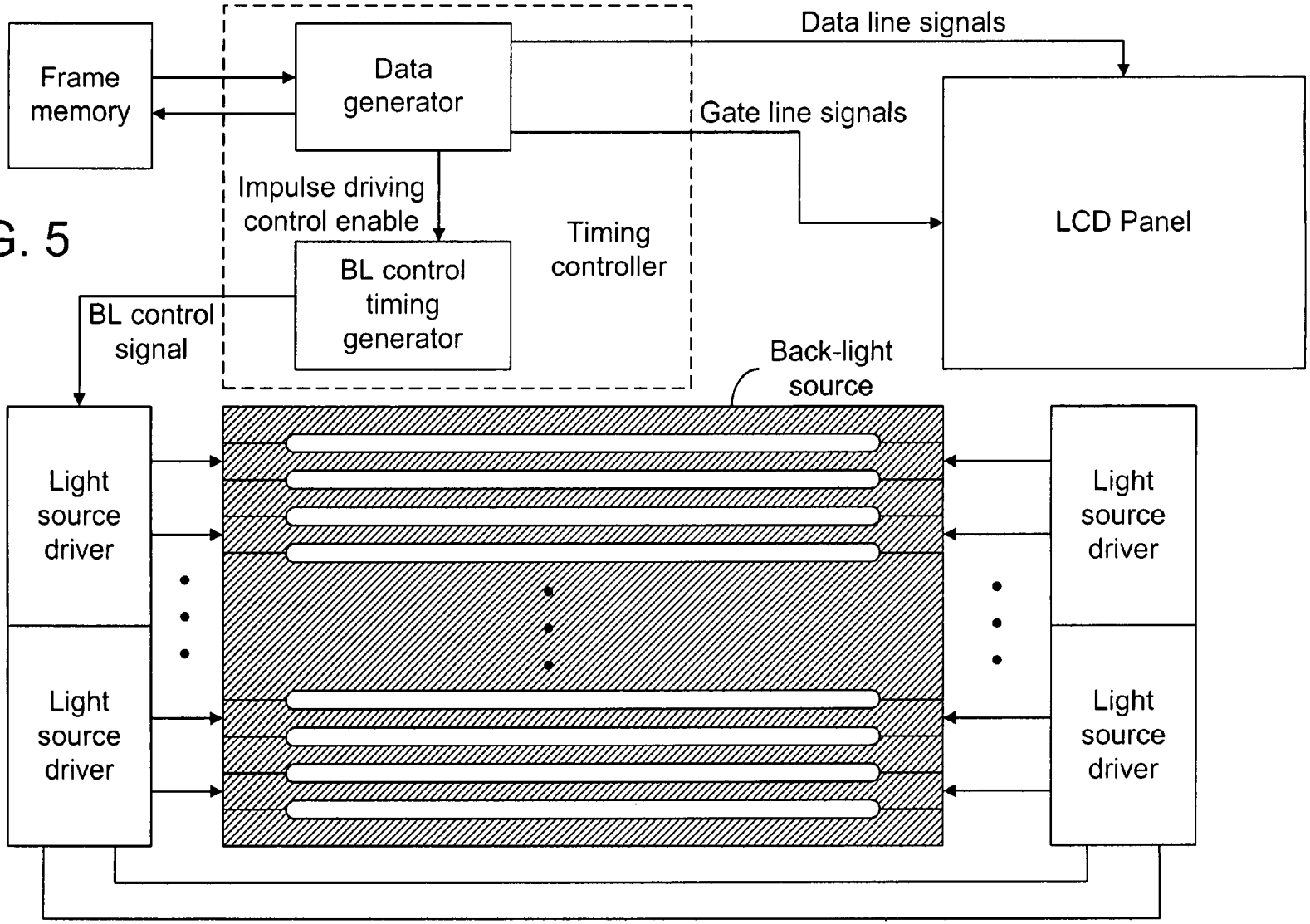
FIG. 5 is a schematic representation of an LCD panel, a back-light source and their drivers.
Figure 6:
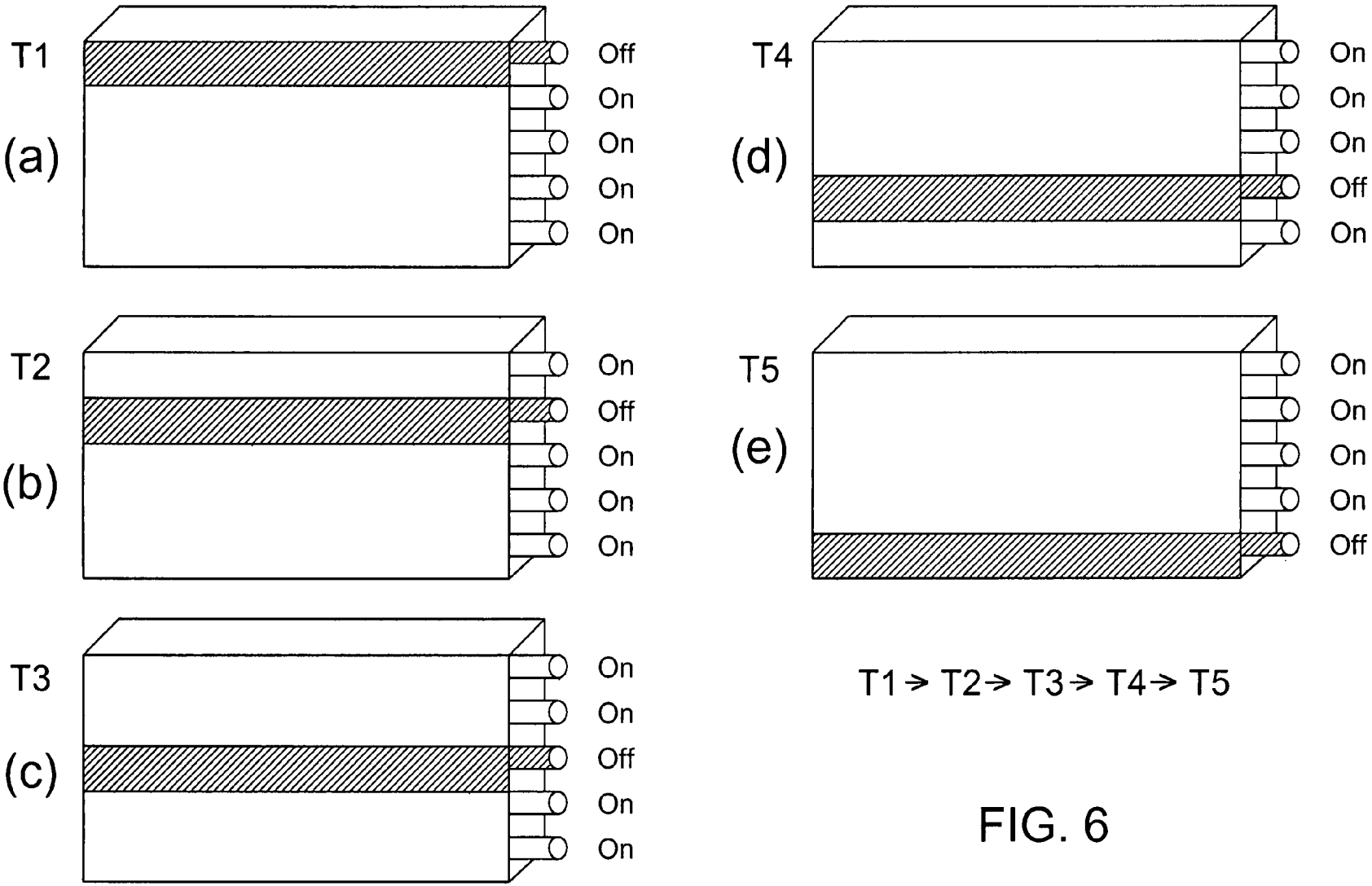
FIGS. 6*a*-6*c* are a schematic representations of a back-light source having a plurality of light source sections, wherein each section can be turned off sequentially and independently of the others in a scanning pattern.

In some back-light sources, such as those having a plurality of light tubes arranged in parallel, the back-light source comprises a plurality of parallel light-source sections as illustrated in FIGS. 5 and 6. It is possible to turn on and off the light-source sections independently from one another. In other back-light sources, such as those having a plurality of LEDs for illumination, the sections may or may not be parallel. When a back-light source has many independently controllable sections, it is preferable to scan the light source in a top-down direction in reference to the LCD panel when the LCD panel is placed in an upright position for viewing. The top-down scanning of the back-light source is illustrated in FIG. 6.

Figure 1:
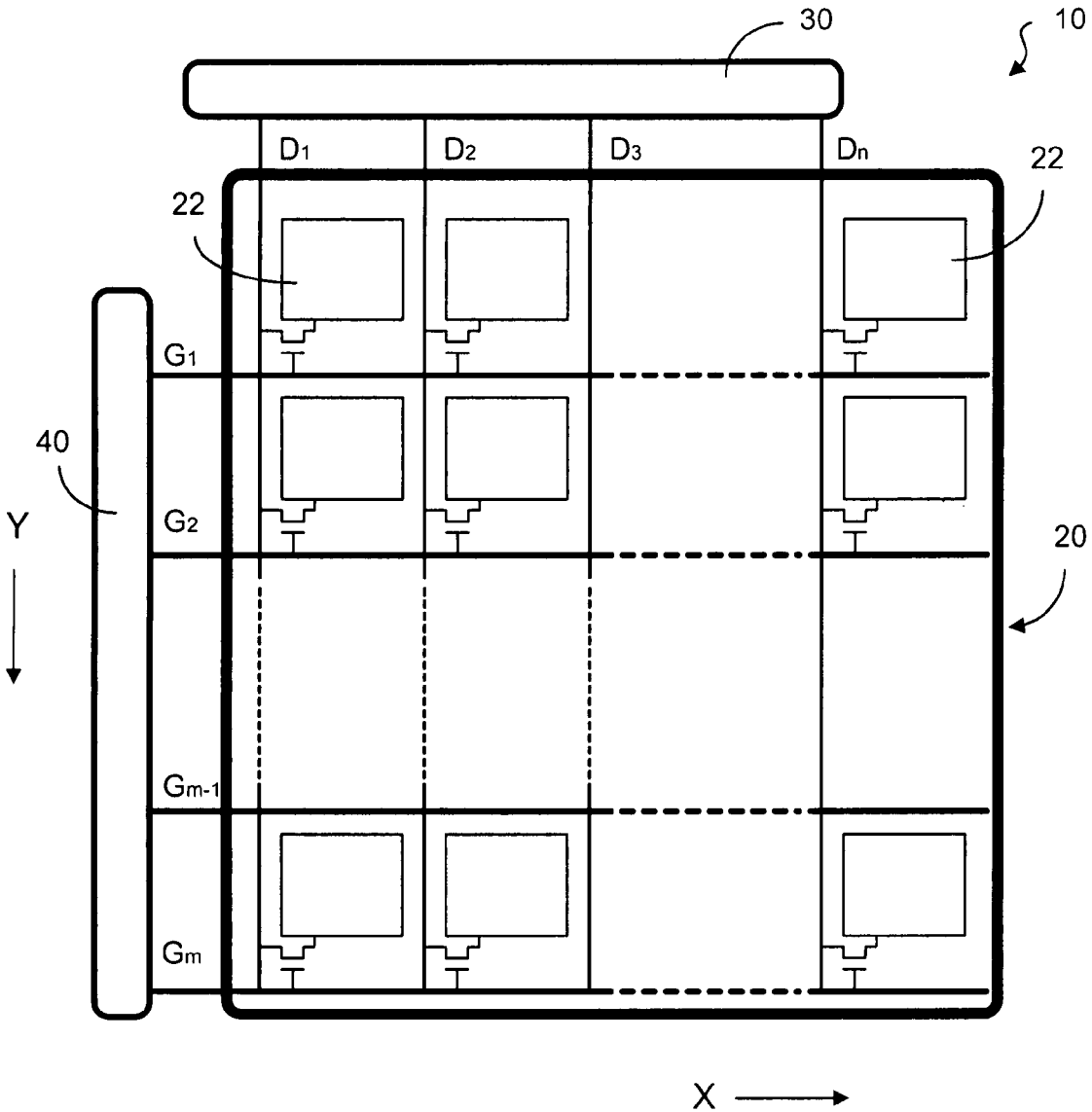
FIG. 1 (prior art)
FIG. 1 is a schematic representation of a display panel having a two-dimensional pixel array.

FIG. 5 shows a system for driving an LCD panel and its back-light source (BL). As shown in FIG. 5, the back-light source has a plurality of parallel light source sections arranged in a horizontal direction in reference to a rectangular LCD panel being placed in an upright position for viewing. As shown in FIG. 5, a plurality of light source drivers are used to drive the back-light source sections. The driving system comprises two modules: a data generation module and a back-light modulation module. These modules can be integrated in a timing controller. The main function of the data generation module is to provide image data to the LCD panel in a plurality of successive frames so as to make the optical response curve of each pixel impulse-like, as shown in FIG. 2. For that purpose, the data generation module is operatively connected to a frame memory module where the image data is stored. The data generation module is also connected to a source driver or data IC and a gate line driver or scanning circuit (see FIG. 1) to convey image data and gate line signals to the LCD panel. Under the control of an impulse driving control enable signal, the back-light modulation module sends a back-light control signal to one or more light source drivers to turn the back-light source on and off in a controlled fashion so as to make the output response to each light source section impulse-like, as shown in FIG. 3.

Figure 7:
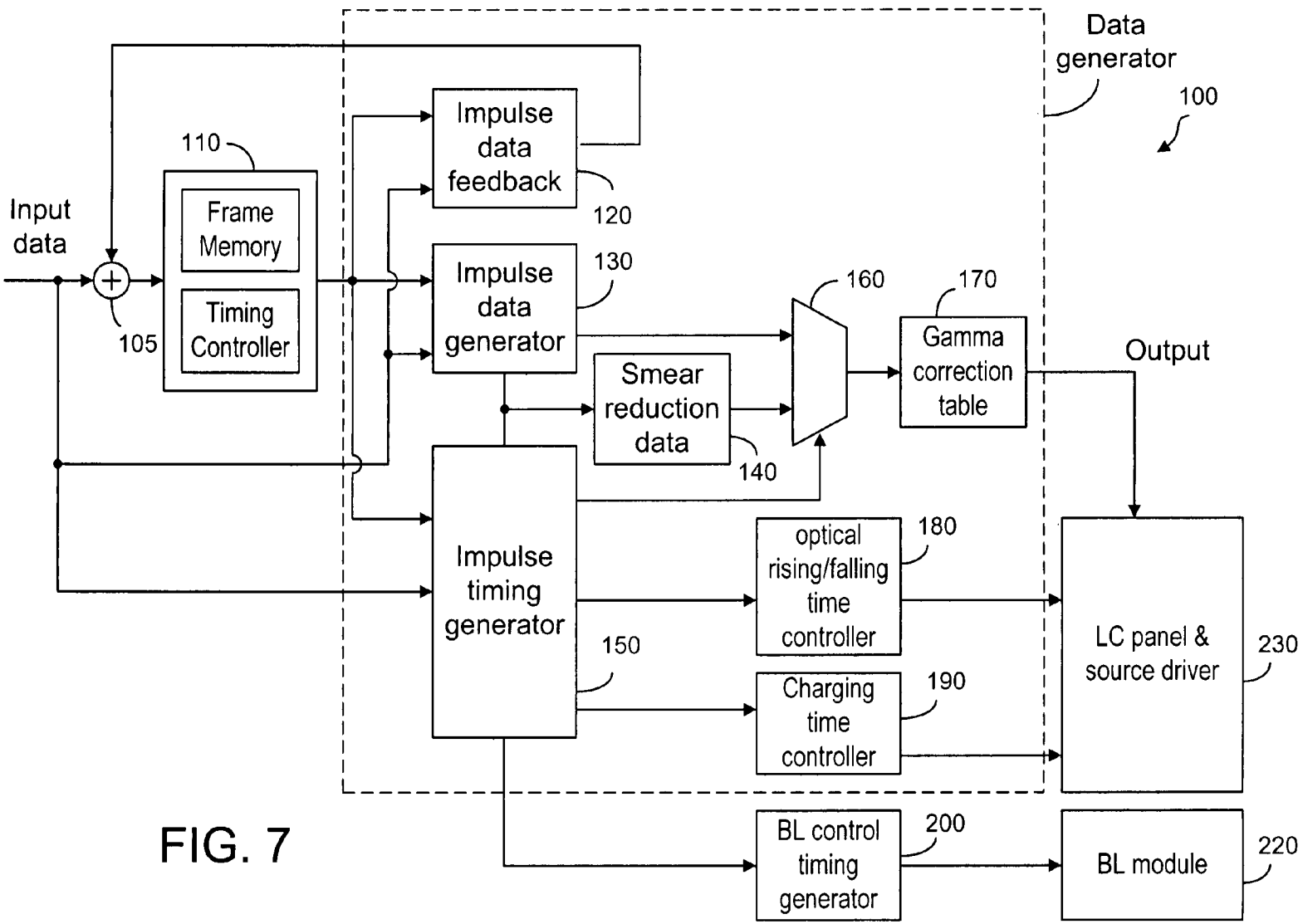
FIG. 7 is a block diagram showing an exemplary timing control unit to achieve the driving method, according to the present invention.

The driving system is further illustrated in FIG. 7 to show various modules and components in the data generation module to achieve the impulse-like optical response, according to the present invention. As shown in FIG. 7, the driving system 100 comprises mainly a data generation module, a frame memory controller 110 and a back-light timing generator 200. After the input data is received from a video card and processed to suit the display panel, the processed input data is stored in a frame memory in the frame memory controller 110. The frame memory controller 110 has two interconnected parts: frame memory and a timing controller for converting processed input data into a suitable form for storage. Furthermore, the stored data in the frame memory can be converted into a suitable form to be used by the timing controller. When the stored input data is retrieved from the frame memory controller, it is conveyed to an impulse timing generator block 150, an impulse data generator block 130 and an impulse data feedback block 120. The impulse data feedback block 120 is a feedback module which is used to process the data in a number of consecutive frames and to convey the processed data to a summing device 105 where the input data and the feedback processed data are subtracted or added before the summing result is stored in the frame memory.

The impulse timing generator block 150 is adapted to compare the processed input data in the current frame with the processed input data in one or more previous frames and to provide an instructive signal based on such comparison. The instructive signal is conveyed to the impulse data generator block 130, an optical rising/falling time controller block 180 and a charging time controller block 190. With the instructive signal, the blocks 130, 140, 180 and 190 decide how to reduce the motion blur depending on the function of the individual blocks. In particular, the impulse data generator block 130 is used to provide output image data to the pixels. The optical rising/falling time controller block 180 is used to control the removal of image data, from a pixel within a frame time for making an impulse-like optical response, for example. The charging time controller block 190 is used to provide the charging time of the pixel electrodes, in order to adjust the control of the charging and discharging time of the liquid crystal, for example.

Advantageously, a smear reduction data block 140 is also used to provide black or gray data insertion for motion blur reduction purposes. When black or gray data is provided for insertion, a multiplexer 160 is used to insert the insertion data at the desirable frames, based on the instructive signal from the impulse timing generator 150.

Moreover, a gamma correction table 170 is used for gamma voltage selection, to make the data provided to the liquid crystal display with a form of impulse-like data display with correct gray level transparency and color temperature. In an impulse-like data display, a pixel appears to be turned on only at a portion of a frame time.

In brief, after the input data is received from a video card and processed to suit the display panel, the input data is stored in a frame memory in the frame memory controller. When the stored input data is retrieved from the frame memory controller, it is conveyed to the impulse timing generator block so as to allow the impulse timing generator block to compare the input data for the current frame with the input data in one or more previous frames. The data comparison result is indexed and conveyed to various controller blocks so as to allow the optical rising/falling time control block to adjust the timing for data removal and the charging time controller block to adjust the charging and discharging of the liquid crystal. The produced signals can be adjusted for motion blur reduction purposes. In addition, black or gray data insertion can be used to reduce the motion blur and the gamma control table can be used to modify the impulse-type display data with correct gamma output. It is possible to disable the optical rising/falling time control block and the charging time controller block so that the impulse-like optical response is achieved by the back-light control image generator alone. Alternatively, one or both of the optical rising/falling time control block and the charging time controller block can be used together with the back-light control image generator.

Figure 12:
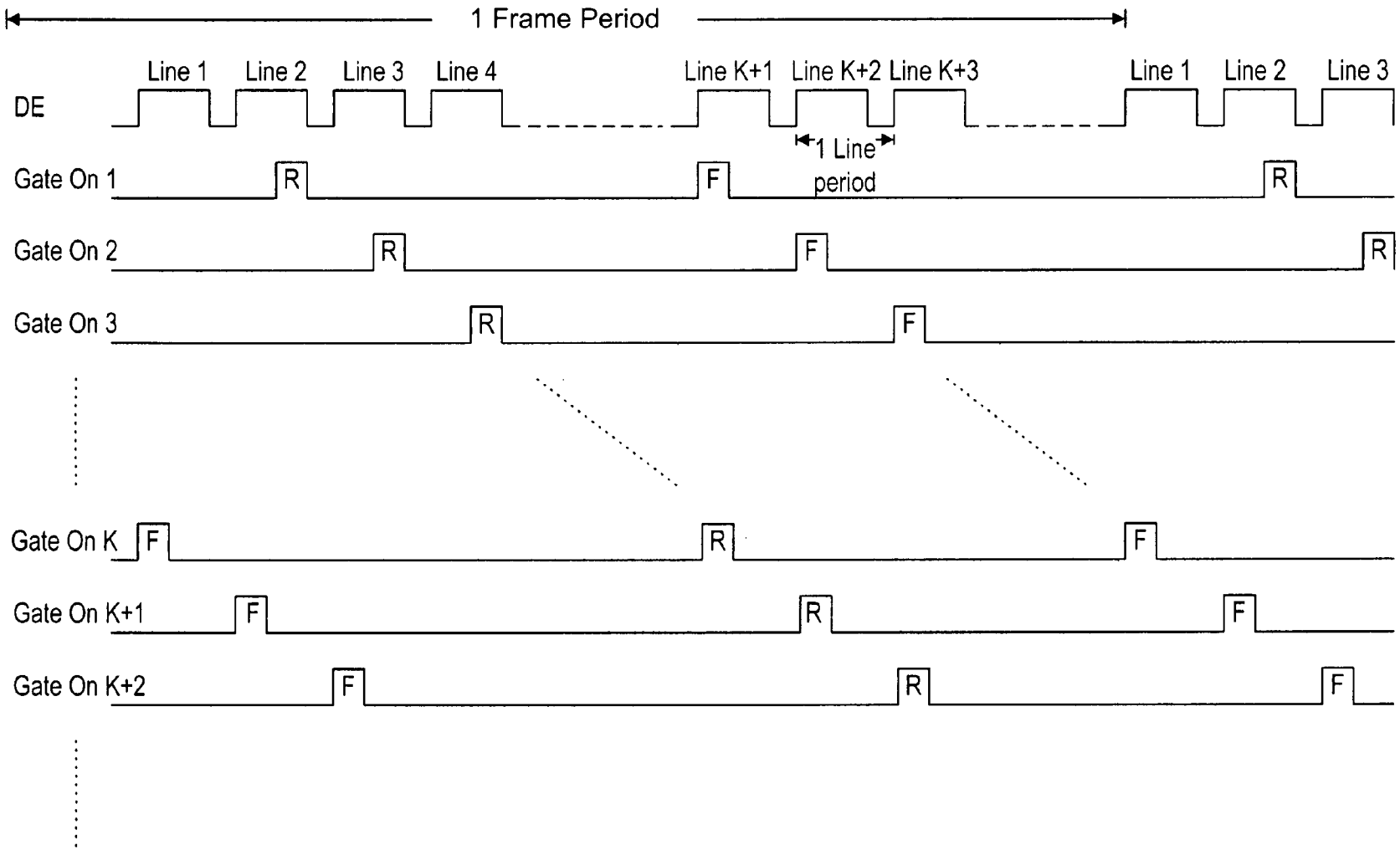
FIG. 12 shows the relationship between the line periods and the gate-ON timing within a frame period.

The optical rising/falling time controller 180 generates a series of control signals, such as the R (rising) and F (falling) control signal associated with the gate-ON signals. These control signals determine the timing of the rising and falling of the optical response curve so as to make the optical response curve impulse-like. The gate-ON timing is illustrated in FIG. 12, showing when the image data is provided to the pixels and when the image data is removed from the pixels within a frame period. FIG. 12 also shows a scanning scheme wherein the Gate-On signals between lines are shifted in a sequential manner. It should be noted that the temporal separation between an R pulse and an F pulse within in a line is determined by K. However, K is not necessarily a fixed number. K is determined based on the performance requirement, the total number of pixel lines in the LCD panel and the response time of the liquid crystal layer, for example. In FIG. 12, DE denotes the data enable signal for each line.

Figure 14:
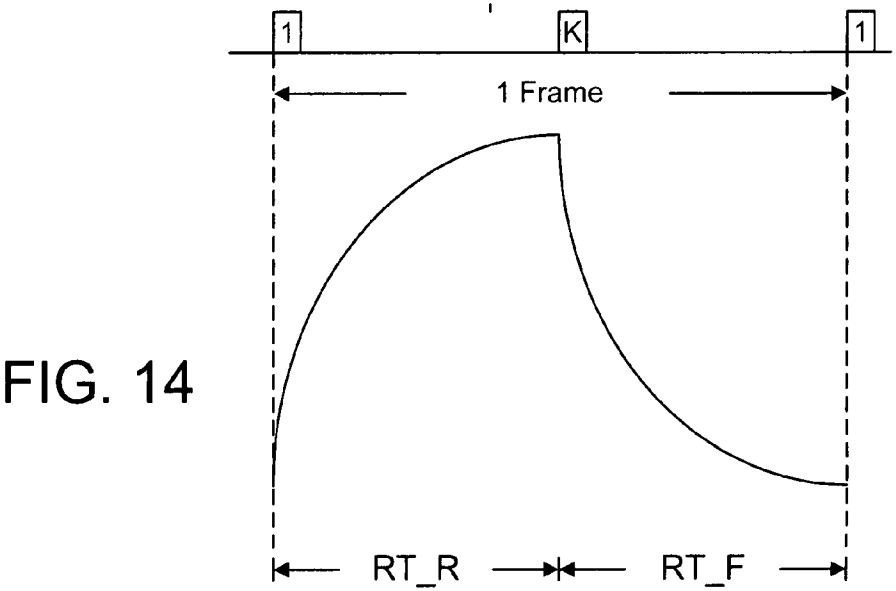
FIG. 14 shows the optical response curve in relationship to K line periods.
Figure 13:
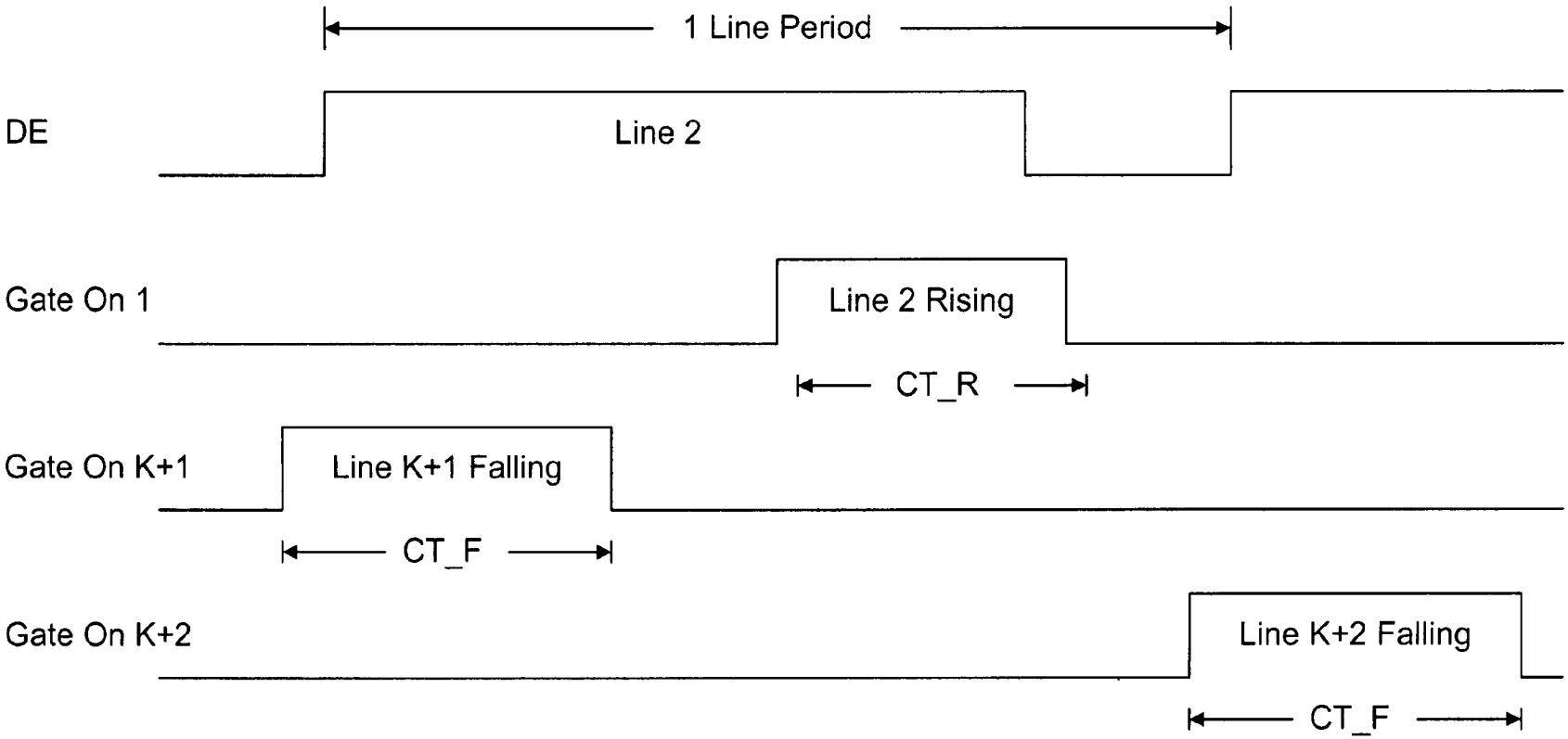
FIG. 13 shows the rising portion in one line period relative to the falling portion of another line period separated by K line periods.

The charging time controller 190 generates control signals for controlling the pixel charging time so as to make the optical response curve impulse-like. The control signals are shown in FIG. 13. FIG. 13 shows the charging time for rising (CT_R) in one line period relative to the charging time for falling (CT_F) of another line period separated by K line periods. FIG. 14 shows the optical response curve in relationship to the K line periods. In FIG. 14, RT_R is the pixel optical response time in the rising period and RT_F is the pixel optical response time in the falling period.

Figure 15:
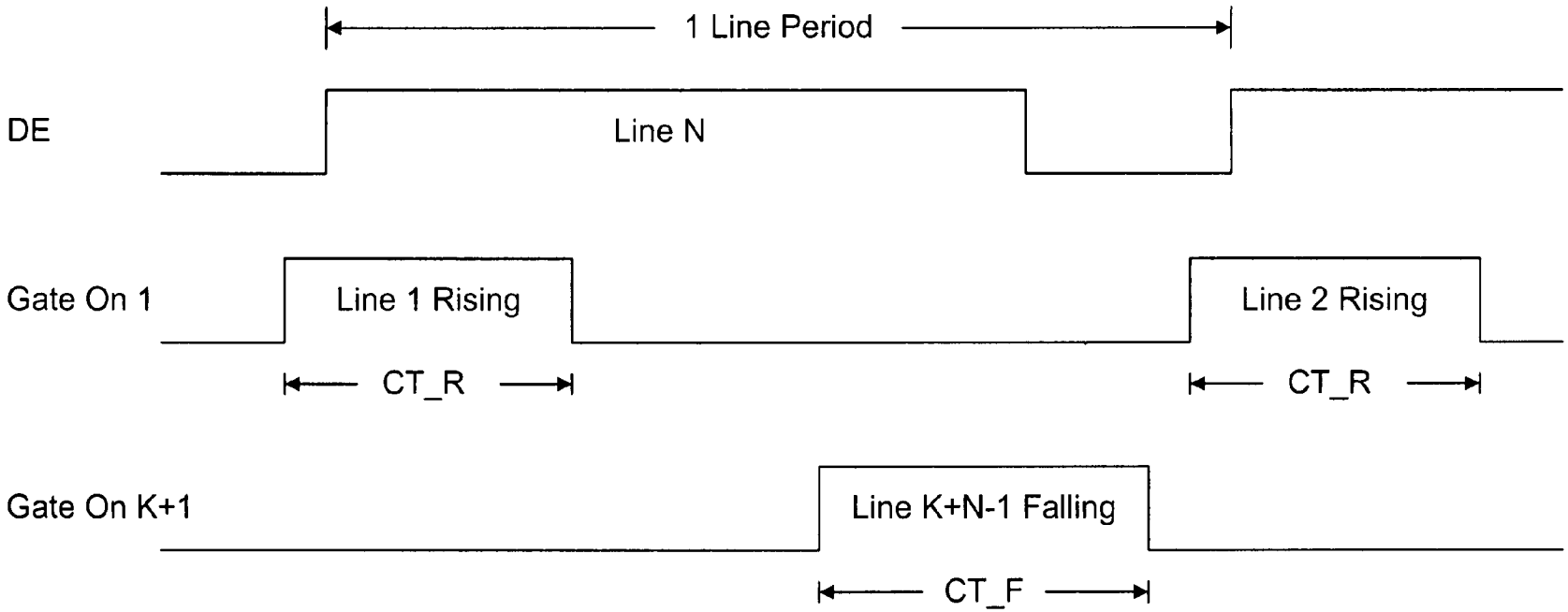
FIG. 15 shows the rising and falling portions in two different lines, according to another embodiment of the present invention.

It should be noted that CT_R and CT_F in different line periods within a frame period can be different from that shown in FIG. 13. In FIG. 13, CT_F in a line occurs at the front section of a line period, whereas CT_R occurs at the rear section of a line period. However, CT_R can occur in the front section and CT_F can occur in the rear section, as shown in FIG. 15.

Figure 8:
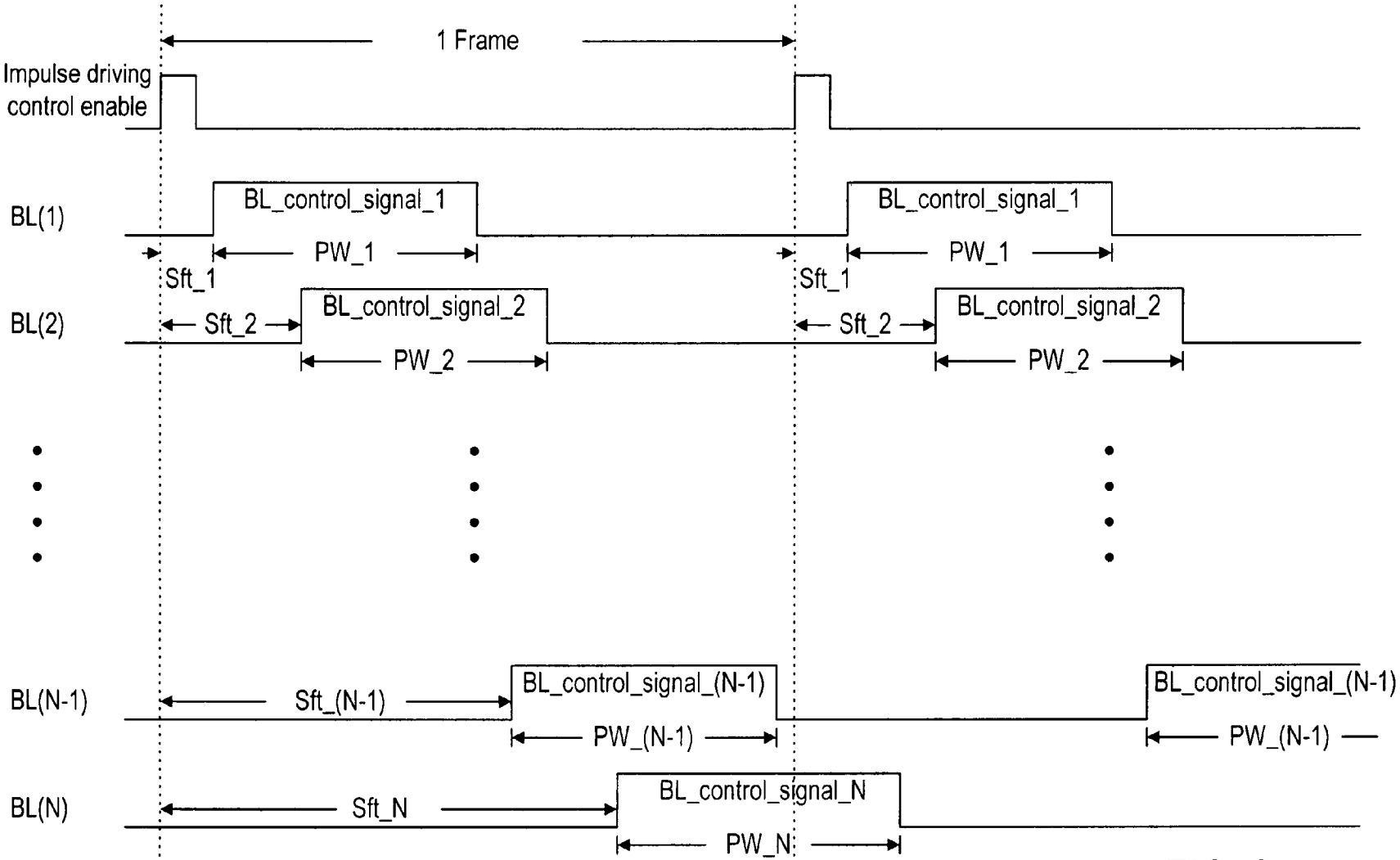
FIG. 8 is a timing diagram showing a series of back-light control signals.
Figure 9:
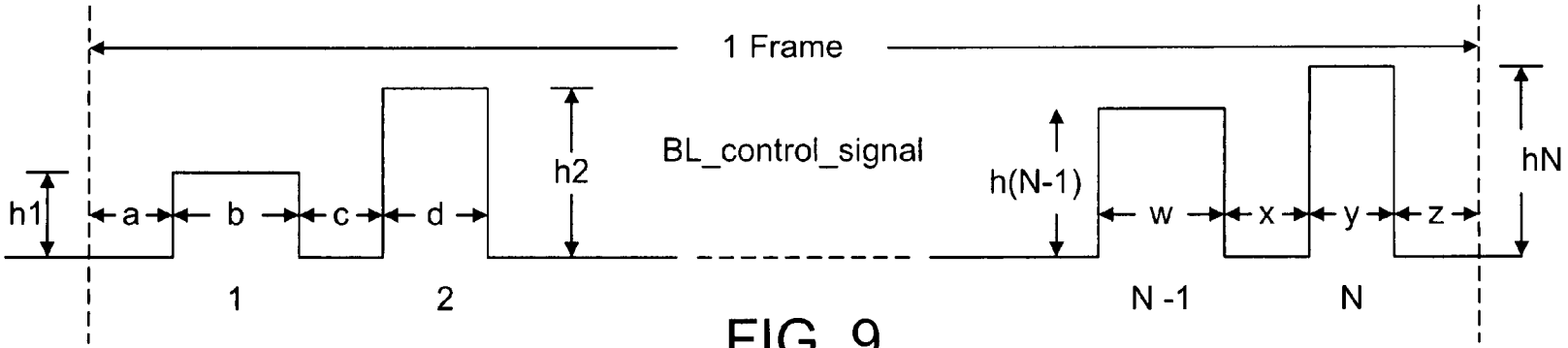
FIG. 9 shows a pulse-width period being broken up into a series of sub-periods, each of which has its own ON/OFF duty and brightness level.
Figure 10:
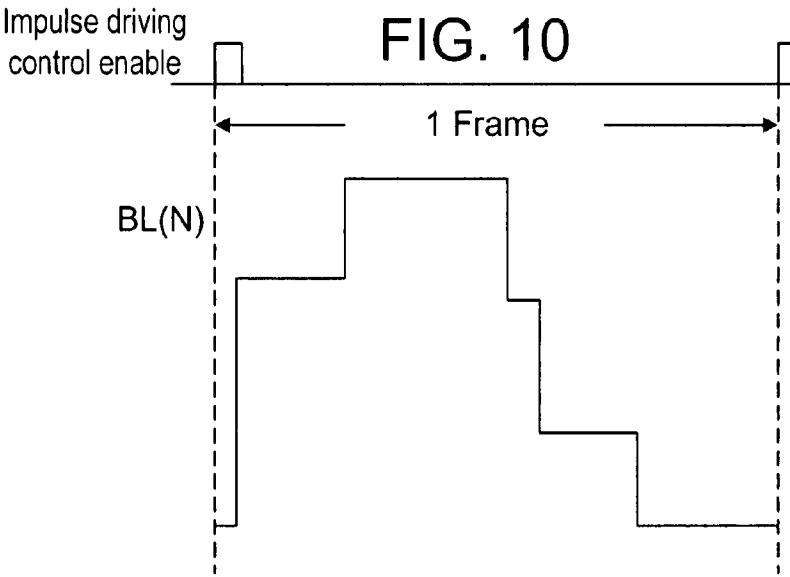
FIG. 10 shows an output response of a light source section as a result of the pulse-width sub-periods, similar to those shown in FIG. 9.

The BL control timing generator 200 has a processor adapted to generate a variety of control signals as shown in FIGS. 8 to 10 as follows:

BL_control_signal: This signal is used for turning one of the light source sections on and off, independently of other light source sections. Each BL_control_signal has a different Shift Time (Sft) and a Pulse Width (PW), as shown in FIG. 8.

Impulse driving control enable (see FIGS. 5 and 8): This signal is a start command from the impulse timing generator 150 to the BL control timing generator 200 and is used as a reference signal for all of the BL_control_signals.

Shift Time (Sft): The Sft signal (see FIG. 8) defines the shift between BL_control_signal and the impulse driving control enable. The shift is determined based on the interaction between different light source sections, and the relationship between the optical response of a pixel and the output response of the back-light source section.

Pulse Width (PW): The PW signal (see FIG. 8) determines the turn-on period for one of the light source sections. The duration of PW is also determined based on the interaction between different light source sections, and the relationship between the optical response of a pixel and the output response of the light source section.

It is possible to separate one PW pulse into M pulse sections, each of which has its own ON/OFF duty (and driving ability, such as lamp current or lamp voltage, h1, h2 . . . ), as shown in FIG. 9, so that the output response of each light source section has a step-like shape, as shown in FIG. 10. In FIG. 9, a, b, c, . . . , w, x, y and z denote the time duration of the ON/OFF signals. For example, b/c is the ON/OFF duty of the pulse section 1.

Figure 11:
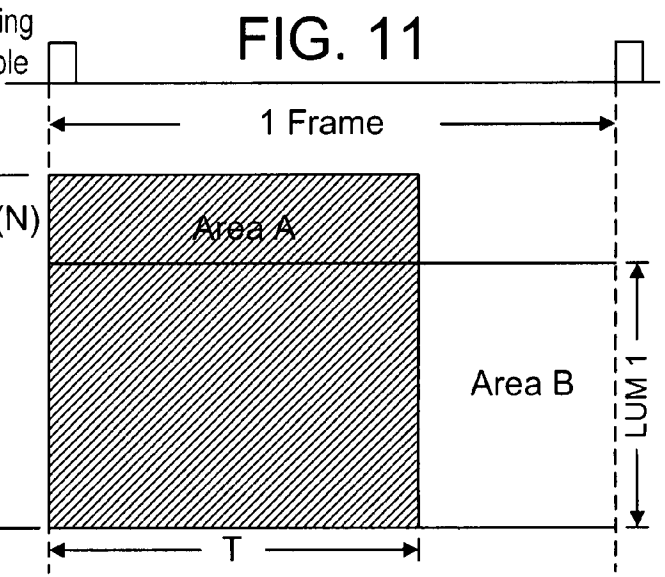
FIG. 11 shows how an ON/OFF duty cycle affects the power consumption, according to the present invention.

The driving system, according to the present invention, may also have a processor or software program to calculate the brightness of the BL based on the ON/OFF duty of the BL light source. As shown in FIG. 11, the output level within a frame time is LUM2 only in an ON-period of T. The product of LUM2 and T is shown as Area A (the shaded area). This product, in terms of power consumer, is equal to Area B, which is the product of LUM1 and the frame time. This calculation can be used to adjust the brightness in order to enhance the viewing quality without increasing the power consumption.

In sum, the present invention provides a method and system to make use of the back-light source more effectively for the impulse-like optical response of the liquid crystal display panel. Because the back-light source is most effectively used at the rising portion of the optical response curve, it would be beneficial to turn off the back-light source at part or all of the falling portion of the optical response curve. By turning the back-light source off at a portion of the frame time, it is possible to increase the illumination of the back-light source at the rising portion without increasing the power consumption for the entire frame or affecting the lift-time of the back-light source. Furthermore, because the falling time in the combined response is faster by turning off the back-light source at the falling portion of the optical response, the motion blur can be reduced.

The impulse-like optical response can be achieved by a black-frame insertion technique and by controlling the electrical charges in a pixel, such as charge sharing. In a display where the pixels are arranged in a plurality of lines and the image data is provided to the lines in a scanning pattern in a scanning direction, it is advantageous to have a back-light source that has a plurality of light source sections. As such, a back-light control module is configured to turn off one section at a time in a sequential manner within the frame period also in a direction substantially parallel to the scanning direction and substantially in synchronism with the scanning pattern.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A method for operating a liquid-crystal display panel having a liquid crystal layer defining a plurality of pixels and a back-light source disposed in relationship to the liquid-crystal display panel, wherein the liquid crystal display panel has a front side for viewing and an opposing back side and wherein the back-light source is adapted to provide light to illuminate the liquid crystal display panel from the back side, said method comprising:

providing image data to at least some of the pixels for forming an image in successive frames, each frame having a frame period; and controlling the back-light source so that said illuminating is provided to said pixels for only part of the frame period, wherein said controlling comprises turning on at least part of the back-light source in a first portion of the frame period and turning off said part of the back-light source in a second portion of the frame period, and wherein the first portion precedes the second portion.

2. The method of claim 1, wherein the image data provided to said at least some of the pixels causes the light, transmitted in said pixels to produce an optical response having a rising portion followed by a falling portion in the frame period, and wherein at least part of the falling portion coincides with at least part of the second portion of the frame period.

3. The method of claim 2, wherein the image data provided to said at least some of the pixels is removed from said pixels for producing the optical response.

4. The method of claim 1, wherein a charging and discharging of electrodes associated with said at least some of the pixels causes the light transmitted in said pixels to produce an optical response having a rising portion followed by a falling portion in the frame period, and wherein at least part of the falling portion coincides with at least part of the second portion of the frame period.

5. The method of claim 1, wherein said controlling further comprises turning off said at least part of the back-light source in another portion of frame period preceding the first portion.

6. The method of claim 1, wherein the pixels are arranged in a plurality of lines and the image data is provided to the lines in a scanning pattern in a scanning direction, and wherein the back-light source comprises a plurality of light source sections and said controlling comprises turning off one section at a time in a sequential manner within the frame period also in a direction substantially parallel to the scanning direction and substantially in synchronism with the scanning pattern.

7. The method of claim 1, wherein said controlling comprises turning on at least part of the back-light source in a first portion of the frame period in steps and turning off said part of the back-light source in a second portion of the frame period.

8. The method of claim 7, wherein the steps include descending steps, and wherein the image data provided to said at least some of the pixels causes the light transmitted in said pixels to produce an optical response having a rising portion followed by a falling portion in the frame period, and at least part of the falling portion coincides with at least part of the descending steps.

9. The method of claim 8, wherein the steps further include ascending steps preceding the descending steps.

10. A liquid-crystal display device comprising:

a liquid-crystal display panel having a liquid crystal layer defining a plurality of pixels, wherein image data is provided to at least some of the pixels for forming an image in successive frames, each frame having a frame period, and wherein the liquid crystal display panel has a front side for viewing and an opposing back side;

a back-light source disposed in relationship to the liquid-crystal display panel for providing light to illuminate the liquid crystal display panel from the back side; and a back-light control module for controlling the back-light source so that the light is provided to illuminate said pixels for only part of the frame period, wherein the back-light control module is configured to turn on at least part of the back-light source in a first portion of the frame period and turn off said part of the back-light source in a second portion of the frame period, and wherein the first portion precedes the second portion.

11. The liquid crystal display device of claim 10, further comprising a data generator for providing the image data to said at least some of the pixels in a controlled fashion, causing light transmitted in said pixels to produce an optical response having a rising portion followed by a falling portion in the frame period, and wherein at least part of the falling portion coincides with at least part of the second portion of the frame period.

12. The liquid crystal display device of claim 11, wherein the data generator is configured to remove part of the image data provided to said at least some of the pixels for producing the optical response.

13. The liquid crystal display device of claim 10, further comprising a charging time controller for controlling charging and discharging of electrodes associated with said at least some of the pixels, causing the light transmitted in said pixels to produce an optical response having a rising portion followed by a falling portion in the frame period, and wherein at least part of the falling portion coincides with at least part of the second portion of the frame period.

14. The liquid crystal display device of claim 10, wherein the back-light control module is configured to turn off said at least part of the back-light source in another portion of the frame period preceding the first portion.

15. The liquid crystal display device of claim 10, wherein the pixels are arranged in a plurality of lines and the image data is provided to the lines in a scanning pattern in a scanning direction, and wherein the back-light source comprises a plurality of light source sections and the back-light control module is configured to turn off one section at a time in a sequential manner within the frame period also in a direction substantially parallel to the scanning direction and substantially in synchronism with the scanning pattern.

16. The liquid crystal display device of claim 10, wherein the back-light control module is configured to turn on at least part of the back-light source in a first portion of the frame period in steps and turn off said part of the back-light source in a second portion of the frame period.

17. A timing control device for use in a liquid-crystal display device comprising:

a liquid crystal display panel having a liquid crystal layer defining a plurality of pixels, wherein image data is provided to at least some of the pixels for forming an image in successive frames, each frame having a frame period, wherein the liquid crystal display panel has a front side for viewing and an opposing back side; and a back-light source disposed in relationship to the liquid-crystal display panel for providing light to illuminate the liquid crystal display panel from the back side, said timing control device comprising:

an optical response control module for causing the light transmitted in said pixels to produce an optical response having a rising portion followed by a falling portion in the frame period, and wherein at least part of the falling portion coincides with at least part of the second portion of the frame period; and a back-light control module for controlling the back-light source so that said illuminating is provided to said pixels for only part of the frame period, wherein the back-light control module is configured to turn on at least part of the back-light source in a first portion of the frame period and turn off said part of the back-light source in a second portion of the frame period, and wherein the first portion precedes the second portion.

18. The timing control device of claim 17, wherein the back-light control module is configured to turn off said at least part of the back-light source in another portion of the frame period preceding the first portion.

19. The timing control device of claim 17, wherein the pixels are arranged in a plurality of lines and the image data is provided to the lines in a scanning pattern in a scanning direction, and wherein the back-light source comprises a plurality of light source sections and the back-light control module is configured to turn off one section at a time in a sequential manner within the frame period also in a direction substantially parallel to the scanning direction and substantially in synchronism with the scanning pattern.

* * * * *